US006053665A

United States Patent [19]

Richardson

[11] Patent Number: 6,053,665

[45] Date of Patent: Apr. 25, 2000

[54] SILT FENCE FABRIC, APPARATUS AND METHOD

[76] Inventor: Patrick C. Richardson, 3165 Boerderij Way, Woodstock, Ill. 60098

[21] Appl. No.: 09/080,866

[22] Filed: May 18, 1998

[51] Int. Cl.[7] ..... E02D 1/00

[52] U.S. Cl. ..... 405/258; 256/12.5; 405/16; 405/108; 405/174; 405/267

[58] Field of Search ..... 405/174–183, 405/50, 38, 258, 267, 108, 16; 256/12.5, 19; 172/699, 771

[56] References Cited

U.S. PATENT DOCUMENTS

| | | | |
|---|---|---|---|
| 2,393,395 | 1/1946 | Millard | 405/176 |
| 4,200,410 | 4/1980 | Baker et al. | 405/181 X |
| 4,279,535 | 7/1981 | Gagllardi et al. . | |
| 4,337,006 | 6/1982 | Lacey | 405/176 |
| 4,720,212 | 1/1988 | Steenbergen et al. | 405/176 |
| 4,756,511 | 7/1988 | Wright, III . | |
| 4,804,299 | 2/1989 | Forte et al. | 405/258 X |
| 4,832,531 | 5/1989 | Paulovits | 405/176 |
| 4,929,126 | 5/1990 | Steenbergen et al. | 405/267 |
| 5,039,250 | 8/1991 | Janz . | |
| 5,108,224 | 4/1992 | Cabaniss et al. | 405/258 X |
| 5,118,230 | 6/1992 | Justice | 405/176 X |
| 5,255,997 | 10/1993 | Bailey et al. . | |
| 5,348,419 | 9/1994 | Bailey et al. . | |
| 5,462,389 | 10/1995 | Messina | 405/183 |
| 5,605,416 | 2/1997 | Roach . | |
| 5,615,499 | 4/1997 | McGuire et al. . | |
| 5,622,448 | 4/1997 | Baum et al. . | |
| 5,660,505 | 8/1997 | Emory, III . | |
| 5,758,868 | 6/1998 | Shea | 405/258 X |

*Primary Examiner*—Dennis L. Taylor
*Attorney, Agent, or Firm*—Mathew R. P. Perrone, Jr.

[57] ABSTRACT

A silt fence fabric with an enlarged edge fits into a slotted blade edge, and is paid out through the slot into the ground as the blade cuts a slit in the ground.

7 Claims, 2 Drawing Sheets

SILT FENCE FABRIC, APPARATUS AND METHOD

This invention relates to a silt fence fabric; and more to a silt fence fabric having a shaped lower edge, and an apparatus for and method of laying the silt fence fabric.

BACKGROUND OF THE INVENTION

Silt fencing is used to prevent erosion or soil run-off. During the construction process, soil must be disturbed, thereby creating unfavorable environmental situations, such as a mud and water mixture entering creeks, streams and lakes.

Current silt fencing installation is not effective in holding power, and is also cumbersome to handle. The speed, with which the silt screen fencing can be installed, also provides excellent characteristics in reducing these situations. Speed is difficult to achieve.

With a silt fence fabric, a construction project may minimize the inherent erosion, during the life of the project. It is also critical, that this fence be positioned efficiently, while at the same time minimizing the resulting erosion caused by the construction process necessary to set up the fence. The solution to the erosion problem at a construction site should not be complicated by the setting up of the erosion fence to minimize the erosion at the construction site.

Two current installation methods for installing silt fence fabrics are used today. Both have substantial problems with installation and erosion. Both also require substantial manpower and larger equipment. Those factors greatly increase the cost of installation.

One installation method requires trenching a line, followed by laying the bottom edge of the silt fence within the trench, and then backfilling dirt or soil into the trench and over the fencing material. The problems created by using this method result from the requirement that the soil has to be disturbed in order to install the fencing. This soil disturbance reduces the holding power of the fence and allows for additional loose soil conditions. This in turn can become a water and mud mixture during washout or blowout condition, which defeats the purpose for the fence.

The second method, known as the cutting wheel static design, encounters several installation problems in rocky or hard soil. Those problems necessitate the use of larger equipment also, which is less maneuverable. It also opens up the possibility for bending or dulling of the cutter wheel, and of cutting the fencing material itself, while it is being forced into the ground with the second wheel.

Yet, the setting up of the erosion silt screen fencing cannot greatly increase the time of construction or interfere with the efficiently of the construction. It is highly desirable to accomplish the construction process in a cost efficient and effective manner with minimal erosion problems and maximize the advantages of both situations.

SUMMARY OF THE INVENTION

Therefore, among the many objectives of this invention is to provide a silt fence fabric with a shaped edge, capable of being placed in position with a slotted plow blade adapted to pay out the fence through the blade into ground slit.

A further objective of this invention is to provide a solidly supported silt fence fabric, at the base thereof.

A still further objective of this invention is to provide a silt fence fabric, which is positioned efficiently.

Yet a further objective of this invention is to provide a silt fence fabric, with minimal erosion.

Also an objective of this invention is to provide a silt fence fabric, with substantially no backfilling required.

Another objective of this invention is to provide a silt fence fabric, without trenching a line.

Yet another objective of this invention is to provide a silt fence fabric, which can be installed in rocky soil.

Still another objective of this invention is to provide a silt fence fabric without cutting the screen or material.

A further objective of this invention is to provide a silt fence fabric, which can be installed in hard soil with ease.

A still further objective of this invention is to provide a silt fence fabric while avoiding the problems with a cutting wheel.

Yet a further objective of this invention is to provide an open, slotted blade for installing a silt fence fabric.

Also an objective of this invention is to provide an open, slotted blade to hold a silt fence fabric in proper position.

Another objective of this invention is to provide a method of installing a silt fence fabric, with increased holding power.

Yet another objective of this invention is to provide a method of installing a silt fence fabric, with minimized soil disturbance.

These and other objectives of the invention (which other objectives become clear by consideration of the specification, claims and drawings as a whole) are met by providing a silt fence fabric with an enlarged edge, which fits into a slotted blade edge, and is paid out through the slot into the ground as the blade cuts a slit in the ground.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
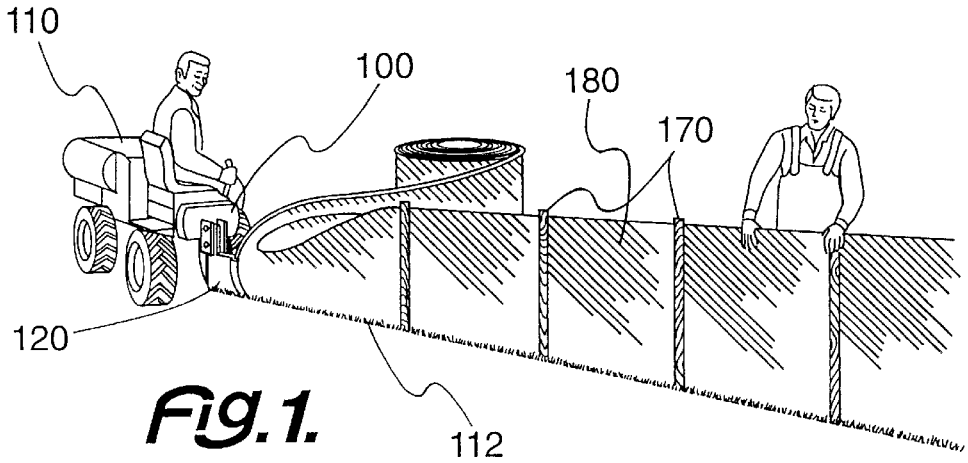
FIG. 1 depicts a perspective view of the slotted blade 120 of this invention in use and mounted on a tractor 110.

The silt fence fabric of this invention is a flat flexible piece of material having an enlarged lower edge. This enlarged lower edge is guided into a slot on a plow blade. As the plow blade parts the earth and forms a slit in the earth, the silt screen is paid out through the slot on the plow blade into a slender trench or slit in the earth. The shaped, lower edge of the silt fence fabric is placed into the slender trench and provides for a strong hold of the fence due to the enlarged shape formed in the bottom edge of the silt fence fabric.

By fabric is meant a sheet of material having a top edge and a bottom edge, being mutually parallel. In most cases, the top edge and the bottom edge are substantially longer than the ends of the sheet are wide. A key feature of this invention is an enlarged bottom edge, adapted to be buried in the ground. The enlarged bottom edge fits in the narrow slit in the ground as provided by the blade. It is then possible to tamp down the soil around the slit, if required. Additionally, stakes are pounded into the ground for additional support of the silt fence fabric.

In this fashion the enlarged bottom edge may cooperate with the slit on the plow blade, so that a one pass treatment can cut a slit in ground and lay the lower edge of the silt fence fabric in the slit. This is a very efficient way of setting up the fence and minimizes the erosion problems caused thereby.

The lower edge of the silt fence fabric may be of any shape desirable cross-section. It is possible to make it a T section, a loop section, a cross-section or any desirable shape. The critical feature of the lower edge is that it be enlarged sufficiently to fit into the slot of the plow blade and grip into the slit in the ground, as it is laid by the slit-making blade from the slot in the blade.

A blade is attached to a standard vibrating plow assembly on a tractor or other power source. At a front edge, the blade may cut a slit in the ground. On the rear edge of the blade is a slot to receive the enlarged edge of the silt screen fencing.

The rear slot in the blade combined with the front cutting edge permits the blade to cut into the ground, and, at the same time, provides tension on the fencing and places it in position in the slit. The required stakes can be then set for vertical support of the silt screen fencing.

A preferred method for placement of erosion control fencing (silt fencing) uses an open slotted vibratory blade design to install the silt fence at a rapid rate. This installation is a much more effective installation method, when compared to prior installation methods.

A slotted blade may be used on current cable plows already in use for installing cable or conduit, using a closed plow blade. A speed fencing slotted blade design, having an open slot in the entire back thereof enables current silt fencing materials to pass through the slot. The silt screen fencing is held in place with the molding or folding of material stitched on the bottom edge of silt fencing.

The vibratory open (slotted) blade design vibrates and cuts the earth, and at the same time passes the silt fencing down an open slot. The materials are being held in place simultaneously, while being passed through an opening at the bottom of the slot in the plow blade. This method enables placement of the fencing in any ground conditions, from perfect soil conditions to rocky soil or hard clay.

More importantly, it provides minimal ground disturbance, and the speed fence method protects the silt fence during the entire installation process, as the fence is protected in the blade until placed. The wear out factor or rock damage of the blade is nonexistent. Lastly, this method enables more use of the small or larger, more maneuverable vibratory plow equipment available today.

The slotted plow blade design may be any suitable shape and is designed to cooperate with a long, enlarged edge of the silt screen fencing, and molding of any kind; whether attached to the top or bottom edge, or both edges; of silt fencing or multiple folding of fencing fabric to the top or bottom of fencing material to achieve holding power in an open slot blade design.

The object of this invention is to provide a silt fencing method which would enable the ease of installation, while utilizing existing equipment with a simple open back (slotted) blade design, and with minor alterations to top-bottom of current silt fencing already in production today.

A blade of this invention has forward cutting edge and a rear slotted edge. Adjacent to the cutting edge of the blade, are mounting apertures for securing the blade to the vibrating member of a tractor. The mounting holes are positioned to fit on existing vibratory members of static plow machines. The holes can be machined to fit any current brand of equipment.

The slot preferably has an arcuate shape for the length dimension thereof. The arcuate shape results in slotted hollow arc having an appropriate length, through which a silt fence fabric may be fed.

Any suitable size for the arc of the slot on the blade may be used. However, the arc is preferably based on a circle about 5 centimeters to 25 centimeters long and up to about 25 centimeters long. More preferably, the arc is based on a circle about 8 centimeters to 23 centimeters long, and about centimeters to about 25 centimeters long. Most preferably, the arc is based on a circle about 10 centimeters to 23 centimeters long, and about 10 centimeters to about 25 centimeters long.

The slot has an interior arc running along the outer edge of the slotted blade. The slot has an opening or entry point for the bottom edge of silt fence. The bottom edge is enlarged with molding or multiple folding attached to the bottom or top of the fence. Such an enlargement provides improved holding in the slot. The enlarged bottom edge fits into the slot on the plow blade.

Referring now to FIG. 1, a slotted plow blade 120 of this invention is mounted on a vibrating member 100 of a tractor 110. Both vibrating member 100 and tractor 110 are standard items, which may either be adapted to slotted blade 120 or have slotted blade 120 adapted thereto. Vibrating member 100 drives slotted blade 120 into ground 112. As tractor 110 pulls slotted blade 120 through the ground 112, fabric 180 pays out through the slot 122 into slit 114.

Figure 2:
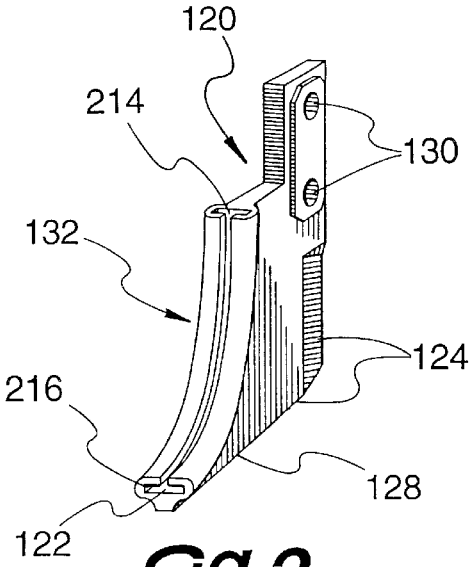
FIG. 2 depicts a perspective view of the slotted blade 120 of this invention, with T-shaped slot 122.
Figure 3:
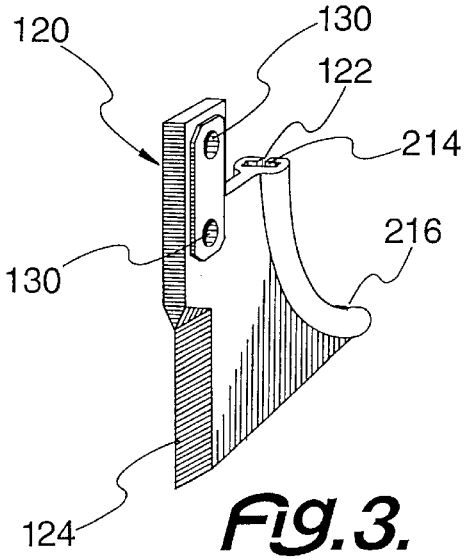
FIG. 3 depicts a perspective view of the slotted blade 120 of this invention, which is a reverse perspective view of FIG. 2.

Adding FIG. 2 and FIG. 3 to the consideration, the slotted blade 120 has a T-shaped slot 122. T-shaped slot 122 receives fabric 180 as desired. Oppositely disposed from T-shaped slot 122 is cutting edge 124 on slotted blade 120. Cutting edge 124 of slotted blade 120 provides slit 114 in ground 112 to receive fabric 180.

On the base 128 of blade 120 is a trapezoid cross-section 130. Such a shape cooperates with cutting edge 124 to provide for penetration of ground 112, when blade 120 vibrates. Fence 180 can then be placed in slit 114.

Blade 120 also includes mounting apertures 130 for securing blade 120 to vibrating member 100. Thus, the structure of blade 120 cooperates with the tractor 110 to lay the enlarged bottom edge 182 of the fabric 180, below the ground 112.

Any cross-sectional shaped for slot housing 132 on blade 120, such as slot 122 or 126, in blade 120 assists in the laying of fabric 180. The cross-section of slot member 132 is adapted to shape of bottom edge 182 of fabric 180. The slot member 132 is arced to facilitate the laying fabric 180 into the ground 112.

Whatever shape bottom edge 182 is, slot member 132 may be adapted to conform thereto. An end point of bottom edge 182 fits into entry point 214 of slot member 132 and leaves slot member 132 at exit point 216, thereby permitting enlarged bottom edge 182 of silt fence fabric 180 to be placed into slit 114 formed in ground 112 at a desired depth. Thus slot member 132 combines with bottom edge 182 to form a female to male relationship.

Figure 4:
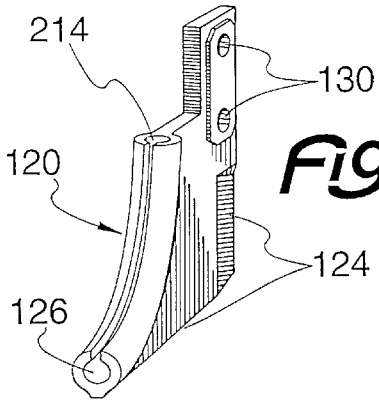
FIG. 4 depicts a perspective view of the slotted blade 120 of this invention, with circular-shaped slot 122.

By considering FIG. 4, it becomes clear that T-shaped slot 122, can be replaced with a circular-shaped slot 126. Then fabric 180 can be appropriately modified. Fabric 180 can have any suitable shape to cooperate with slotted blade 120

Figure 5:
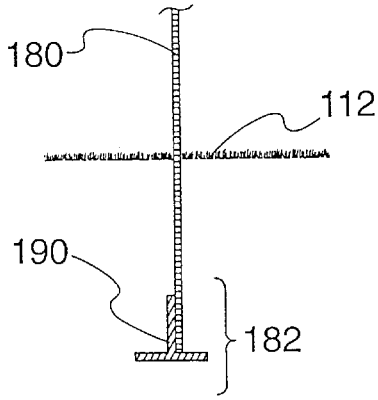
FIG. 5 depicts an end, partially cross-sectioned view of silt fence fabric 180, having a T-shaped edge 190.

In FIG. 5, silt fence fabric 180 is depicted as having a T-shaped edge 190. T-shaped edge 190 can be molded or otherwise formed in the silt fence fabric 180. T-shaped edge 190 can be fed into the ground 112 through T-shaped slot 122 of blade 120. By T-shaped is meant that the cross-section has the shape of a T.

Alternatively and preferably, T-shaped edge 190 can be formed from a separate piece of material. If a separate piece of material is used, T-shaped edge 190, is sewn, glued, bonded or otherwise secured to bottom edge 182 of fabric 180.

FIG. 1 and FIG. 5 combine to depict stakes 170 supporting fabric 180. Stakes 170 are required with any style of fabric 180. The shaped bottom edge 182 greatly enhances the holding power of the fence fabric 180. As can be seen, bottom edge 182 may be enlarged in any suitable fashion.

Figure 6:
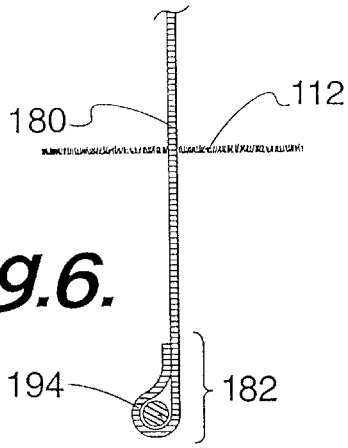
FIG. 6 depicts an end, partially cross-sectioned view of a silt fence fabric 180, having a looped edge 194.

With another embodiment, FIG. 6 depicts silt fence fabric 180, having a looped edge 194. Looped edge 194 is formed with an open hem 202. Open hem 202 is formed by a loop fold 204 and securing the edge 182 to the fabric 180 to create an elongated slot 208. Rope 210 or other flexible cord may be inserted in slot 208. In this fashion elongated slot 208 may hold fabric 180 in round or circular-shaped slot 126 as desired.

Figure 7:
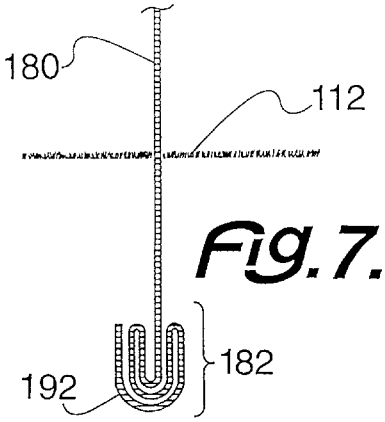
FIG. 7 depicts an end, partially cross-sectioned view of a silt fence fabric 180, having a folded edge 192.

In FIG. 7, silt fence fabric 180 is depicted as having a folded edge 192. Folded edge 192 enlarges bottom edge 182 by folding bottom edge 182 over itself. The flat fold 200 thus formed is then secured by welding, sewing or gluing in a standard fashion. In this way, enlarged bottom edge 182 may be formed.

Figure 8:
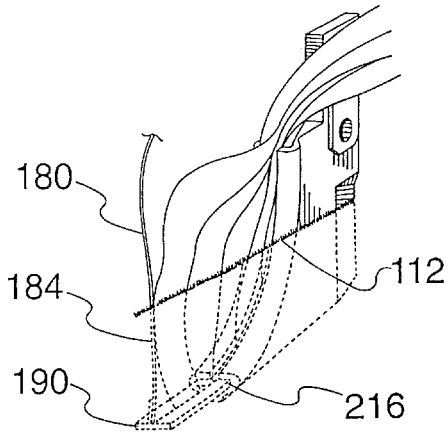
FIG. 8 depicts a perspective view of a silt fence fabric 180 placed at an underground point 184 by blade 120.

In FIG. 8, silt fence fabric 180 is placed at an underground point 184 by blade 120. In this fashion, T-shaped edge 190 under the ground 112 as it leaves exit point 216, thereby permitting enlarged bottom edge 182 as T-shaped edge 190 to be placed into slit 114 a desired depth. No backfilling is needed. Ground 112 is just stamped down.

With consideration of leading cutting edge 124 of blade 122 to cut path for blade 120 to follow, as it is vibrated and pulled through the ground 112. The fence 180 is laid at the bottom edge 182. Through slot 122 or 126, it is clear from this disclosure that the slot shape is adapted to the shape of bottom edge 182. The bottom edge 182 may be a rope or molding of any suitable shape be it round, square, rectangle or other appropriate. Such shape may be attached to the bottom edge 182 or the, oppositely disposed, top edge of the silt fence fabric to enhance the holding power in the speed fence open slotted blade design.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A slotted plow blade adapted for use with a silt fence fabric having an enlarged lower edge, comprising:

(a) the slotted plow blade having a slot assembly on a rear edge thereof and a front cutting assembly on a front edge thereof;

(b) the slot assembly being oppositely disposed from the cutting assembly;

(c) the slot assembly having a shaped cross-section adapted to receive the enlarged lower edge in a female to male relationship;

(d) the slot assembly being adapted in order to permit the silt fence fabric to protrude from enlarged lower edge through the slot assembly.

2. The slotted plow blade of claim 1 further comprising:

(a) the slot assembly having an arcuate shape for a length dimension thereof;

(b) the slotted plow blade having a lower cutting assembly on a lower edge thereof;

(c) the slotted plow blade having a mounting assembly oppositely disposed from the lower cutting assembly; and (d) the mounting assembly being adapted for securing the blade to a vibrating assembly on a tractor.

3. The slotted plow blade of claim 2 further comprising the arcuate slot having a T-shaped cross-section.

4. The slotted plow blade of claim 2 further comprising the arcuate slot having a circular cross-section.

5. In a method for positioning an elongated silt fence fabric at a construction site to reduce erosion, the improvement comprising:

(a) providing a slotted blade, with a fabric receiving slot;

(b) providing an enlarged long edge for the elongated silt fence fabric;

(c) securing the slotted blade to a vibrating member, the vibrating member being mounted on a tractor;

(d) feeding the enlarged edge through the fabric receiving slot, the fabric receiving slot being adapted in order to permit the silt fence fabric to protrude from enlarged lower edge through the slot assembly;

(e) vibrating the slotted blade;

(f) forming a slit in the ground while moving on a desired path; and (g) securing the enlarged edge below a ground level.

6. The method of claim 5 further comprising:

(a) the securing of the enlarged edge in the ground further including tamping down the slit;

(b) the feeding of the enlarged edge through the fabric receiving slot further including starting the enlarged edge at a top portion of the slot and dispensing the enlarged edge at a bottom portion of the slot; and (c) the bottom portion of the slot being below the ground level when dispensing.

7. The method of claim 6 further comprising:

(a) supporting the fence fabric with at least one stake; and (b) retrieving the blade after the silt fence fabric is installed.

* * * * *